US007497234B2

(12) United States Patent
Robinson

(10) Patent No.: US 7,497,234 B2
(45) Date of Patent: Mar. 3, 2009

(54) STORM WATER FLOW RESTRICTION METHOD AND APPARATUS

(76) Inventor: Bruce Locke Robinson, 2068 Firestone Trace, Bath, OH (US) 44333

( * ) Notice: Subject to any disclaimer, the term of this patent is extended or adjusted under 35 U.S.C. 154(b) by 492 days.

(21) Appl. No.: 11/147,605

(22) Filed: Jun. 8, 2005

(65) Prior Publication Data

US 2006/0278289 A1 Dec. 14, 2006

(51) Int. Cl.
*F15D 1/02* (2006.01)

(52) U.S. Cl. ..... 138/44; 138/45; 405/40; 210/163; 210/170.03

(58) Field of Classification Search ..... 138/45, 138/44; 405/40, 42; 210/163, 164, 170.03; 404/4, 5

See application file for complete search history.

(56) References Cited

U.S. PATENT DOCUMENTS

| | | | | | |
|---|---|---|---|---|---|
| 1,398,063 | A | * | 11/1921 | Brown | 48/189.4 |
| 2,687,147 | A | * | 8/1954 | Feichter | 138/44 |
| 3,517,700 | A | * | 6/1970 | Zee et al. | 138/44 |
| 3,840,051 | A | * | 10/1974 | Akashi et al. | 138/37 |
| 3,938,713 | A | | 2/1976 | Pielkenrood | 222/486 |
| 3,958,603 | A | * | 5/1976 | Bannon et al. | 138/43 |
| 4,522,533 | A | | 6/1985 | Campbell et al. | 405/36 |
| 5,080,137 | A | | 1/1992 | Adams | 137/810 |
| 5,322,629 | A | | 6/1994 | Stewart | 210/767 |
| 5,341,848 | A | * | 8/1994 | Laws | 138/44 |
| 5,495,872 | A | * | 3/1996 | Gallagher et al. | 138/44 |
| 5,549,817 | A | | 8/1996 | Horsley et al. | 210/122 |
| 5,664,760 | A | * | 9/1997 | Army et al. | 251/118 |
| 5,707,527 | A | | 1/1998 | Knutson et al. | 210/660 |
| 6,638,424 | B2 | | 10/2003 | Stever et al. | 210/170.03 |
| 6,783,683 | B2 | | 8/2004 | Collings | 210/669 |
| 7,089,963 | B2 | * | 8/2006 | Meheen | 138/44 |
| 7,303,048 | B2 | * | 12/2007 | Gallagher et al. | 181/296 |
| 2004/0055816 | A1 | * | 3/2004 | Gallagher et al. | 181/256 |
| 2005/0103694 | A1 | * | 5/2005 | Rost et al. | 210/164 |

* cited by examiner

*Primary Examiner*—Patrick F Brinson
(74) *Attorney, Agent, or Firm*—David L. King

(57) ABSTRACT

A feature of the present invention is it is adaptable to any pre-existing storm catch basin system. Another feature of the present invention is that it permits empirical analysis and verification of the draw down rate. Another feature is the present invention can be adjusted or modified to increase or decrease the rate of draw down after it has been installed to insure regulatory conditions are precisely met without difficulty. Changes in future regulatory draw down rates can be easily implemented.

A flow restriction device has an orifice plate, the orifice plate having a frontal surface area A and at least one opening for the passage of fluid of an area Oa, wherein Oa is less than A. The flow restriction device may also employ a screen debris plate, the screen debris plate having a plurality of spaced openings for the passage of fluid; the sum area of the openings being Σ Osp wherein Σ Osp is greater than Oa.

6 Claims, 13 Drawing Sheets

STORM WATER FLOW RESTRICTION METHOD AND APPARATUS

FIELD OF THE INVENTION

This invention relates to a device and method for controlling the rate of flow from storm water runoff through a catch basin or similar device.

BACKGROUND OF THE INVENTION

Storm water runoff can carry sediment from soil erosion and other residues from a retention pond or other water holding area if it is allowed to be released too rapidly.

The adverse effects of such uncontrolled storm runoff effluents are well documented. The Federal Clean Water Act (CWA) regulates storm water discharge through the National Pollutant Discharge Elimination System (NPDES) that require a storm water pollution prevention plan (SWP3) to be prepared for each site. The post-construction best management practices (BMP's) require a 48 hour draw down time for extended detention basins. (dry basins). The longer draw down period for storm water discharges are for water quality purposes.

This regulation mandates a rate of draw down that is substantially slower than previously allowed. The benefits of such a draw down rate are believed to be providing more time for small particle contaminants to settle in the detention basin bed.

The primary problem is there has been no catch basin overflow structures built or designed to handle such slow rates of discharge. Accordingly, a simple and efficient way to convert or retrofit existing structures to meet the new standards is needed. Similarly new structures need to be developed that can be designed with controlled runoff rates based on the surrounding requirements of the detention basin or ponds and therefore each new system ideally would be able to be custom sized for the conditions to achieve the desired rate of storm water draw down.

Several approaches to achieving controlled rates of flow have been attempted in storm water drainage systems. U.S. Pat. No. 4,522,533 discloses a tapered flow restriction with a cover plate having a predetermined aperture at an end. The tapered part being inserted into the end of a sewer pipe. The flow restrictor is used to prevent storm water backup in urban sewer systems which results in flooding of basements and other significant inconveniences. Similarly U.S. Pat. No. 5,080,137 teaches Vortex Flow Regulators for Storm Sewer Catch Basins, the flow being controlled by a spiraled shape to restrict the rate of flow initially and which increases in area outwardly along the spiral permitting large volume flows to the catch basin or manhole to be accommodated where it is installed. The spiral flow was believed to be less prone to clogging. U.S. Pat. No. 3,938,713 taught a Flow Regulator for sediment collecting chambers of a separating device.

None of these devices provides a way to optimally size or control the draw down rate for an overall catch basin system at rates of outflow less than 1.0 cfs.

One system used a plurality of conventional rip rap filled with gabion boxes aligned end to end to restrict the rate of flow of storm water runoff in areas under construction wherein high mud levels were commonly found. The problem with this flow restriction system is the effectiveness or flow rate changes are dependent on the amount of debris trapped in the system.

Other more sophisticated approaches relying on complete systems can be found in U.S. Pat. Nos. 6,783,683; 6,638,424; 5,707,527; 5,549,817 and 5,322,629 none of which teach a way to achieve such a long draw down time as 48 hours or longer to achieve water quality volume.

A feature of the present invention is it is adaptable to any pre-existing storm catch basin system Another feature of the present invention is that it permits empirical analysis and verification of the draw down rate.

Another feature is the present invention can be adjusted or modified to increase or decrease the rate of draw down after it has been installed to insure regulatory conditions are precisely met without difficulty.

Changes in future regulatory draw down rates can be easily implemented.

SUMMARY OF THE INVENTION

A flow restriction device has an orifice plate, the orifice plate having a frontal surface area A and at least one opening for the passage of fluid of an area Oa, wherein Oa is less than A. The flow restriction device may also employ a screen debris plate, the screen debris plate having a plurality of spaced openings for the passage of fluid; the sum area of the openings being $\Sigma$ Osp wherein $\Sigma$ Osp is greater than Oa.

The flow restriction device preferably also includes a pipe having at least one threaded end and a first coupling for attaching to the at least one threaded end. The orifice plate is retained by the first coupling or the pipe or the combination when assembled.

The first coupling has an outside dimension larger than said pipe.

The flow restriction device of the preferred embodiment also has a second coupling for attaching to an opposite second end of the pipe; and wherein said screen debris plate is retained by the second coupling or the pipe or the combination when assembled.

The second end of said pipe is preferably also threaded and said second coupling is threaded to attach to said pipe at said second end. The second coupling has an outside dimension larger than said pipe.

The flow restriction device may alternatively use a pipe and one or more flanges in place of said couplings, wherein said pipe has one or more threaded ends and said one or more flanges have threads for securing said pipe in an opening in a wall.

The flange may have an end for retaining said orifice plate and a threaded joint for attaching to one end of the threaded pipe, wherein said orifice plate is removably retained.

The flow restriction device assembly may have a first flange having a central screen debris plate having a plurality of spaced openings and a projecting end; a second flange having a recessed portion and a projecting end; an orifice plate retained in said recessed portion; and wherein said first and second flange ends can be joined at said respective projecting ends. The flow restriction device assembly may further have a threaded pipe, said threaded pipe being joined to the respective projecting ends and interposed between ends of said flanges.

The method of restricting drainage flow from a catch basin has the steps of: placing a removable or modifiable first flow restrictor plate with one or more flow openings of a predetermined open area (Oa) in an outlet or orifice of a catch basin wall or drain pipe or in-line of a drain pipe; measuring the time required to draw down the catch basin after a first flush rain event; and increasing or decreasing the time to draw down by either removing the flow restrictor plate and replacing with a second flow restrictor plate having more or less flow opening area or modifying said first flow restrictor plate by plugging some of the flow area or increasing said flow area by adding to or enlarging the one or more flow openings; more area (Oa+) increasing flow volume, less area (Oa−) decreasing flow volume.

The method may further have the steps of: calculating the required increase or decrease of area (A) required to draw down the catch basin at a predetermined time after a first flush rain event; and re-measuring the time to draw down after a first flush rain event.

Definitions

Weir—as used herein refers to a wall or obstruction used to control flow from settling tanks or catch basins or ponds to ensure a uniform flow rate First Flush Rain Event—as used herein refers to the small volume of runoff that occurs at the beginning of a rain storm. It carries with it concentrations of pollutants such as sediment, trash, heavy metals, oils, etc that have accumulated during dry weather between storms.

BRIEF DESCRIPTION OF THE DRAWINGS

The invention will be described by way of example and with reference to the accompanying drawings in which.

DETAILED DESCRIPTION OF THE INVENTION

Figures 1, 1A:
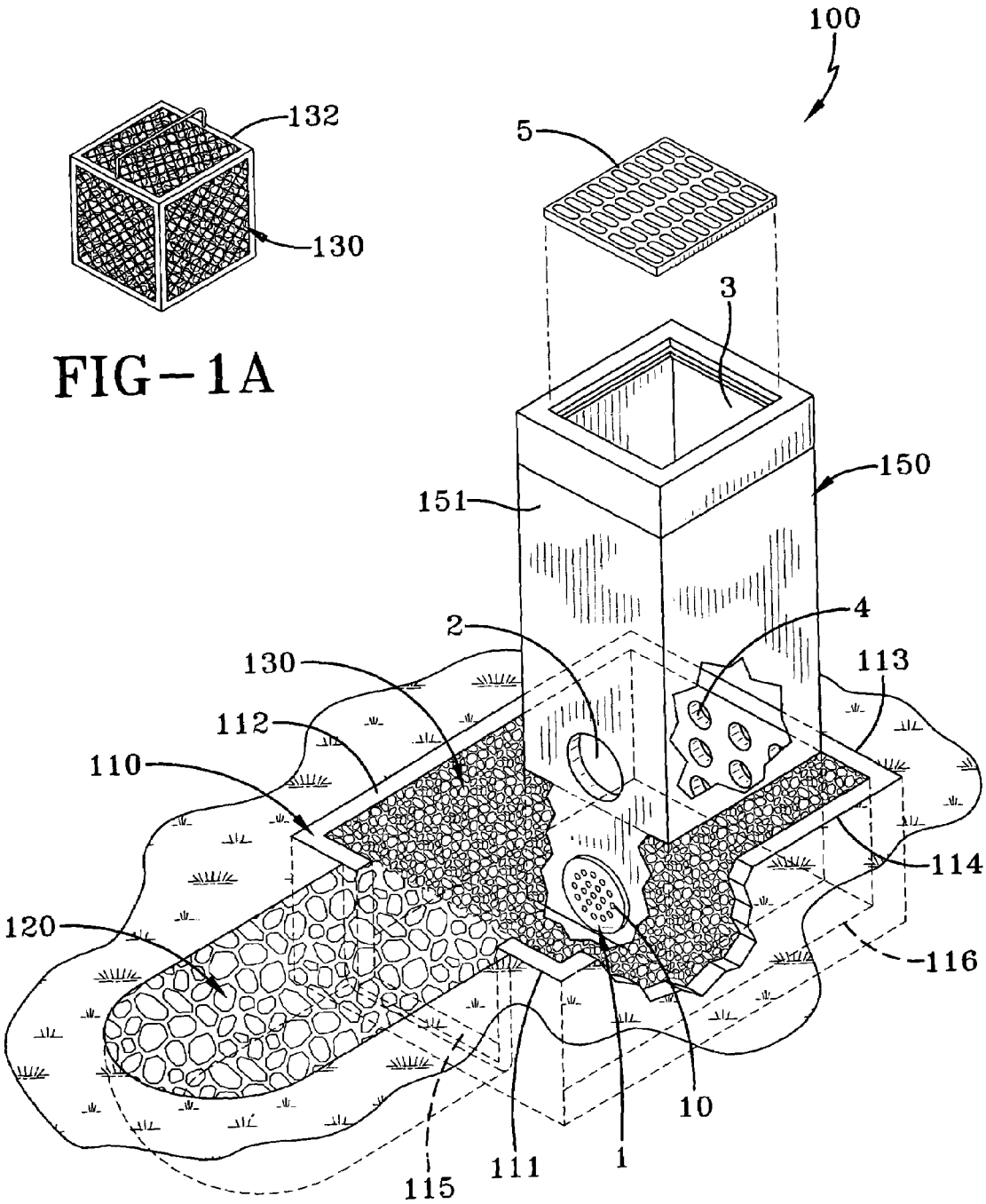
FIG. 1 is a perspective view of an exemplary catch basin overflow device including a submerged weir and a primary structure including a secondary weir overflow.
FIG. 1A is a perspective view of the stones used in the submerged weir in an exemplary wire box enclosure.

With reference to FIG. 1 a perspective view of an exemplary catch basin 100 is shown. The catch basin 100 as illustrated has a submerged or at least partially submerged weir structure base 110. The submerged weir structure base 110 is a concrete structure having four walls 111, 112, 113, 114 one of which is an inlet wall 111 cut with a rectangular weir opening 115 to allow storm water to inflow. As shown, the inlet wall 111 has a rock channel 120 in front of it to minimize the inflow of soil and to act as a pre-filter.

Inside the walls of the submerged weir structure base 110 is placed a primary concrete structure 150 surrounded by smaller stones 130, preferably a mixture of #1 and #2 stone filled to a level preferably about equal to the height of the walls 111, 112, 113, 114. In a more preferred embodiment these stones 130 are encased in gabion boxes 132 as shown in FIG. 1A to permit removal for cleaning and replacement.

Near the floor 116 of the submerged weir structure base 110 is a submerged orifice 1 covered in the bed of stones 130, the stones 130 being a filtering means between the larger rocks 120 at the inlet 115 and the submerged orifice 1. The submerged orifice 1 is an opening into the primary structure 150. The primary structure 150 is the tall concrete structure set back on the floor 116 in the submerged weir structure base 110 and it has a primary overflow orifice 2 located in a wall 151 at a level just above the stone filter bed 130. On the back side of the primary structure 150 are one or more outlet openings 4 to which a discharge or outlet pipe (not shown) can be connected. At the top of the primary structure 150 is a screen or grate 5 covered secondary weir overflow 3 for inletting storm water into the primary structure 150 when the level rises too rapidly to be accommodated by the submerged orifice 1 or primary orifice 2.

Figure 2A:
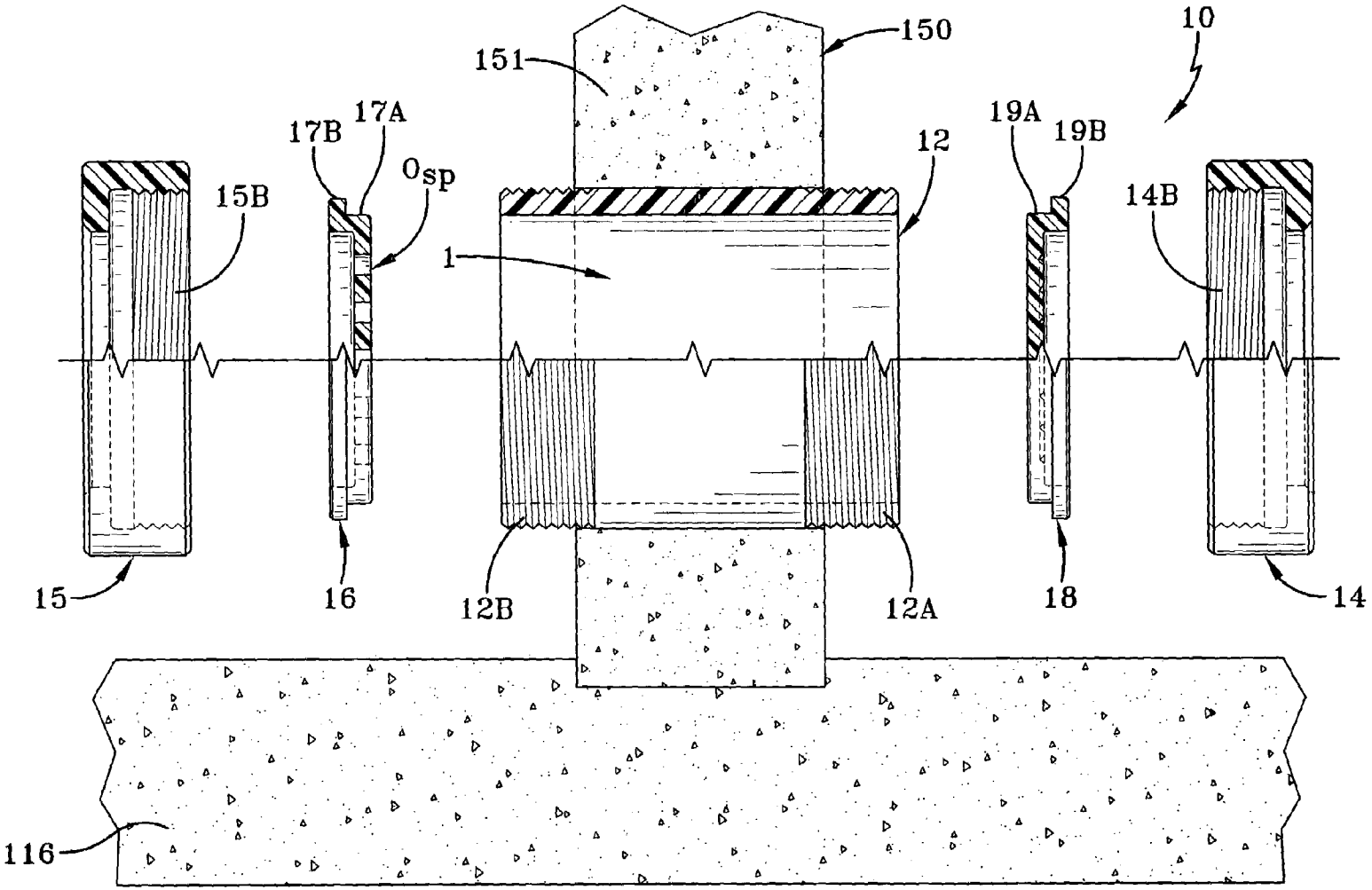
FIG. 2A is a partial cross sectional view of the submerged orifice with a preferred flow restrictor prior to assembly according to the preferred embodiment of the invention.

Attached to the submerged orifice 1 is a flow restrictor device 10 according to the present invention. While shown in the orifice 1 of the wall 151, the restrictor devices of the present invention can be used in any drainage orifice including drain pipes wherein the restrictor device may be attached at an end or as a coupler between pipe sections. With reference to FIG. 2A a cross sectional view of the preferred flow restricting device assembly 10 is shown unassembled. The assembly 10 has a pipe 12 with threaded ends 12A, 12B protruding through the wall 151 at the orifice opening 1. On each end of the pipe 12 a threaded end cap coupling 14, 15 can be attached. The threaded couplings 14, 15 have a diameter or external dimension sufficiently large to securely hold the pipe 12 in the wall 151.

Figure 2B:
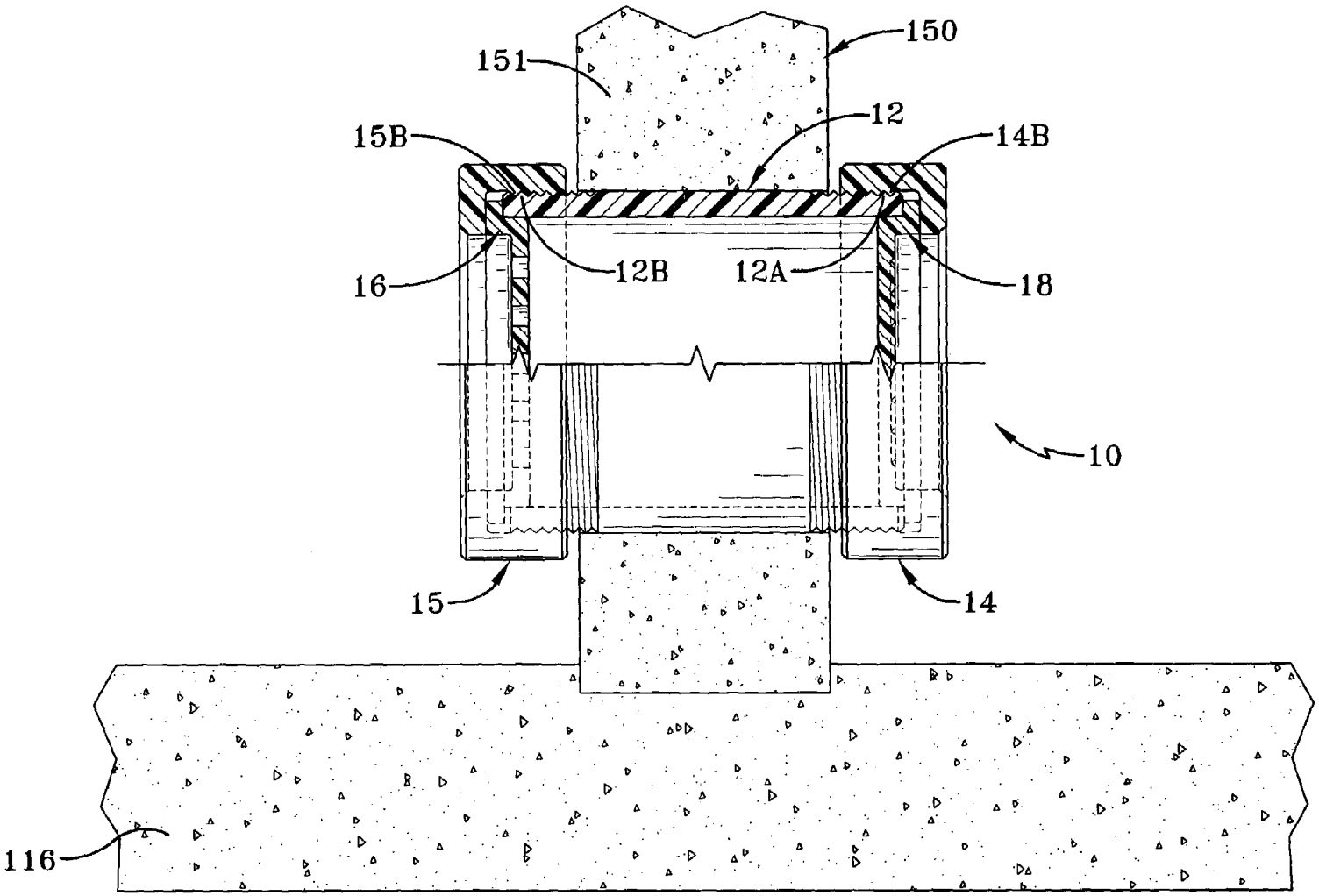
FIG. 2B is a view of the flow restrictor of FIG. 2A shown assembled.
Figure 3:
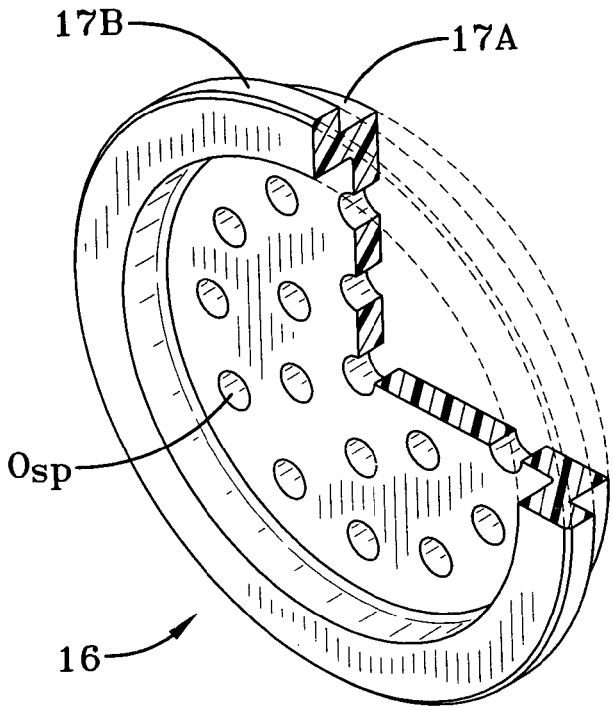
FIG. 3 is a perspective view of the screen debris plate.

At an upstream or inlet end 12B of the pipe 12 is located a screen or perforated debris plate 16 having a plurality of openings Osp, the sum of the area of the opening being $\Sigma$ Osp. The screen debris plate 16 as shown is held in place by the pipe 12 and coupling 15 when assembled. FIG. 3 shows the screen debris plate 16 in an enlarged perspective view, an inner diameter portion 17A being sized to fit inside the pipe 12 and the outer diameter portion 17B has a surface to abut against the wall of the pipe 12. As shown in FIG. 2B, the coupling 15 when threaded onto the pipe 12 holds firmly the portion 17B securing the plate 16.

Figure 4:
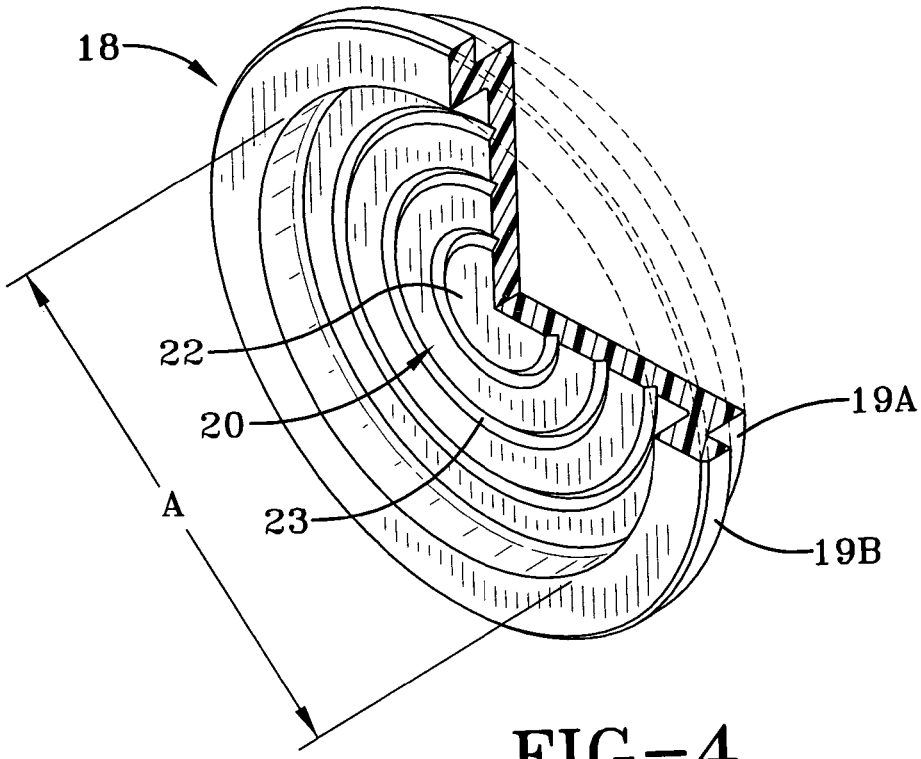
FIG. 4 is a perspective view of an orifice end cap.

At a downstream end or discharge end 12A of the pipe 12 is an orifice plate 18. As shown in FIG. 4, the orifice plate 18 has a frontal surface area A on a wall 20 and at least one opening, aperture or cut out site 22 for the passage of fluid having an area of Oa, Oa being less than A.

In one preferred method, the orifice plate 18 may have no opening 22 until assembled or just prior to assembly. In that case an opening 22 can be cut or drilled through the plate wall 20 of a size Oa predicted to be sufficient for proper draw down to store the first flush rain event. In any case the sum of the area Σ Oa of the orifice opening is less than the area Σ Osp of the optional screen debris plate 16, if such a plate 16 is used.

After a first flush rain event, the area Oa can be increased if needed by enlarging the orifice or opening 22 or by adding one or more additional orifice openings 22. In any event the sum or enlarged open area Σ Oa should be less than the area Σ Osp so that the flow restriction is in fact regulated at the orifice plate 18.

The flow restriction device 10 as shown in FIG. 2B has male threaded pipe ends 12A, 12B and mating female threaded couplings 14, 15. This permits easy assembly and disassembly. Alternatively the couplings 14, 15 can be attached by gluing or solvent bonding directly to the pipe 12 if so the use of threaded ends is not required, but may be used if desired or the device 10 may employ one end solvent welded and the other end removably attached if so desired. In any event one of the primary benefits of the present invention relates to the fact that the restriction of the flow can be tuned or adjusted to precisely match a pre-existing catch basin 100. This means that any pre-existing storm water drainage system can be retrofitted to meet the new slow draw down rate requirement without requiring a new system or costly modifications.

While the preferred embodiment as shown in FIGS. 2A and 2B uses a screen debris plate 16 it must be appreciated that the assembly 10 could optionally not use such a device. In such a case it is recommended that a pre-filtering device should be employed.

In FIG. 1 as shown the pre-filtration device may be stones 130 such as #1 and #2 stones lying loose or retained in wire cages 132 as in FIG. 1A which can be removed and replaced as they clog or can be cleaned and flushed easily for reuse.

Again, such use of pre-filtration assists in capturing or blocking debris from entering the flow restrictor device 10 and changing the optimal flow rates by blocking some or all of the openings 22.

A significant benefit of the present invention is that any maintenance crew can make the necessary installation and even if first time estimate of required orifice opening area Oa is wrong, a simple method of replacing or modifying the orifice plate 18 will be possible. To increase flow restriction to further slow the draw down rate the area Oa can be reduced by replacing the orifice plate with one having a small opening area. Conversely, the increase in flow rate to adjust the draw down time to a quicker rate or time is simply accomplished by increasing the opening area Oa by replacing the plate or simply drilling more holes or cutting, drilling or punching out a larger hole or otherwise modifying the already installed plate 18. As shown in FIG. 4, the knockout grooves 23 permit the installation crew to select various sized openings 22.

Since the plates 15, 16 and the overall device 10 are preferably made of HDPE or PVC such modification can easily be made in the field.

Figure 5:
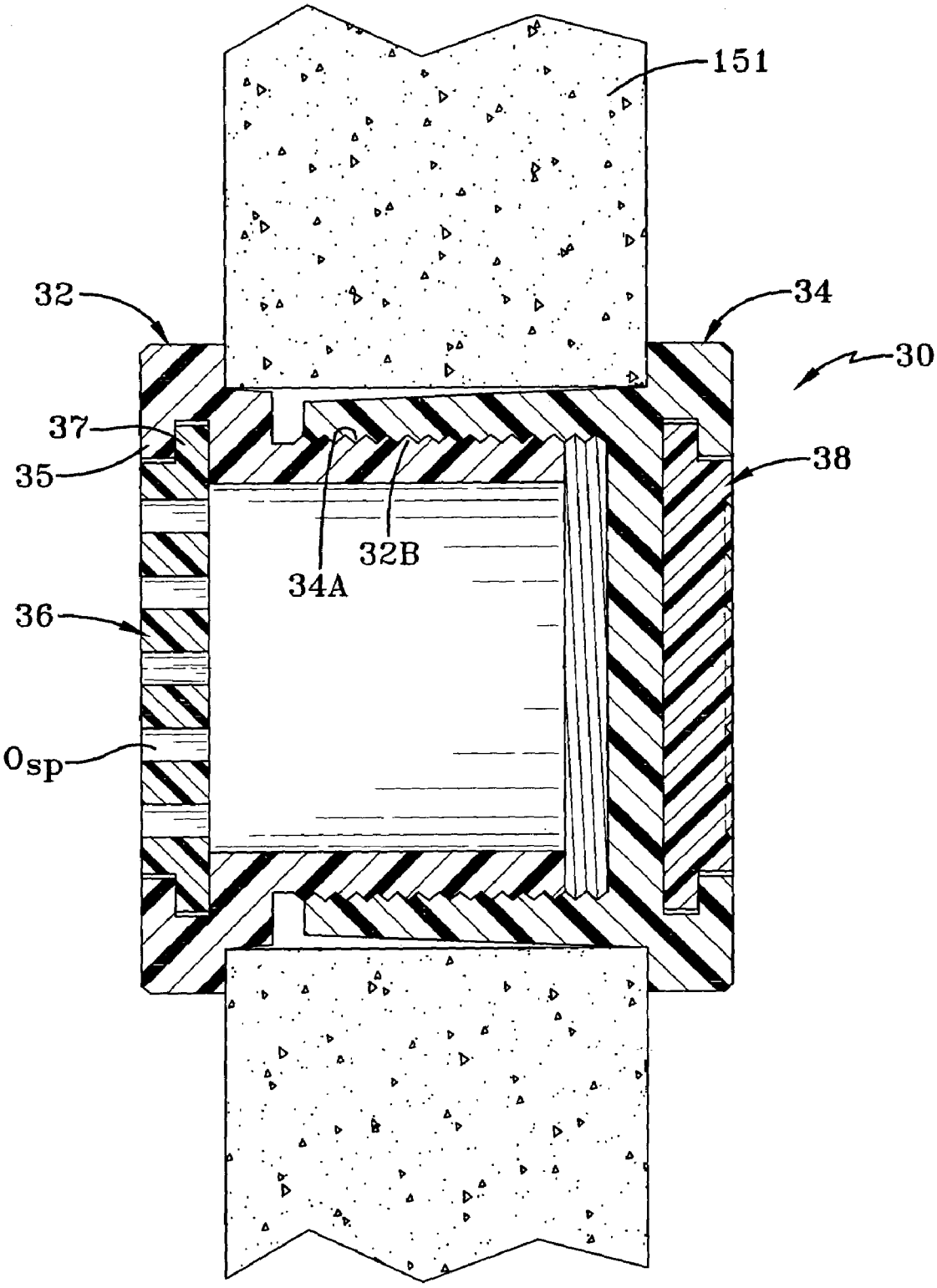
FIG. 5 is a partial cross sectional view of a first alternative according to the present invention installed in the catch basin overflow device.
Figure 6:
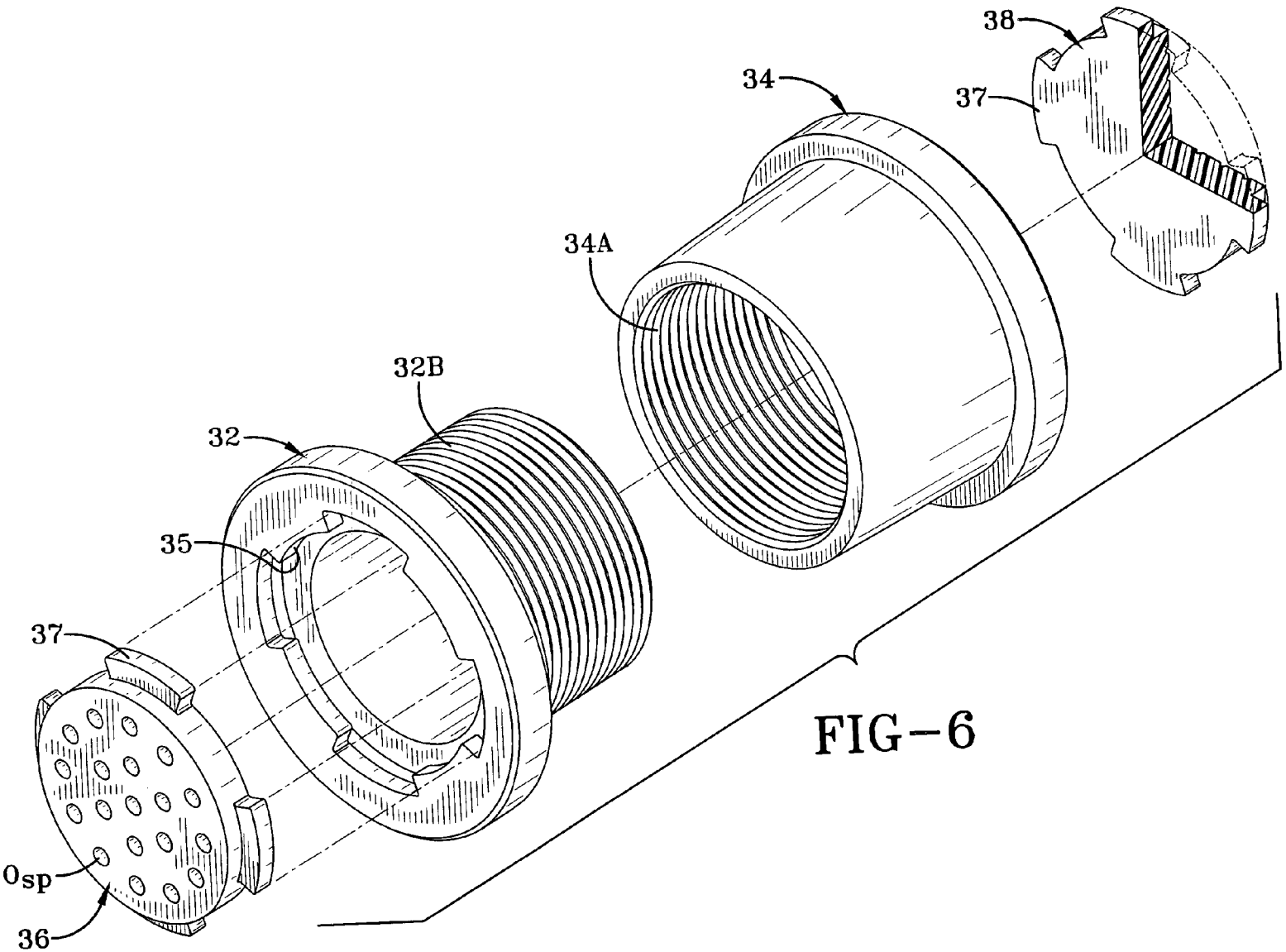
FIG. 6 is a perspective exploded view of the first alternative embodiment of FIG. 5.
Figure 7A:
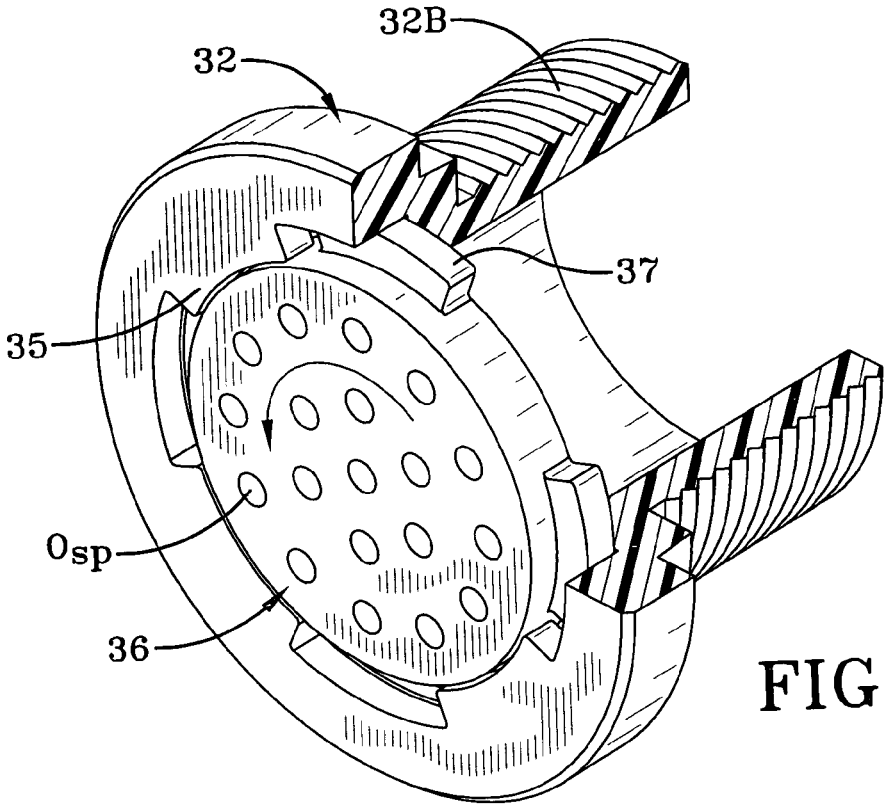
FIG. 7A is a perspective view of a screen debris plate assembled to a flange portion from FIG. 6 showing a partial cut away view of a quarter turn attachment for the screen debris plate.
Figure 7B:
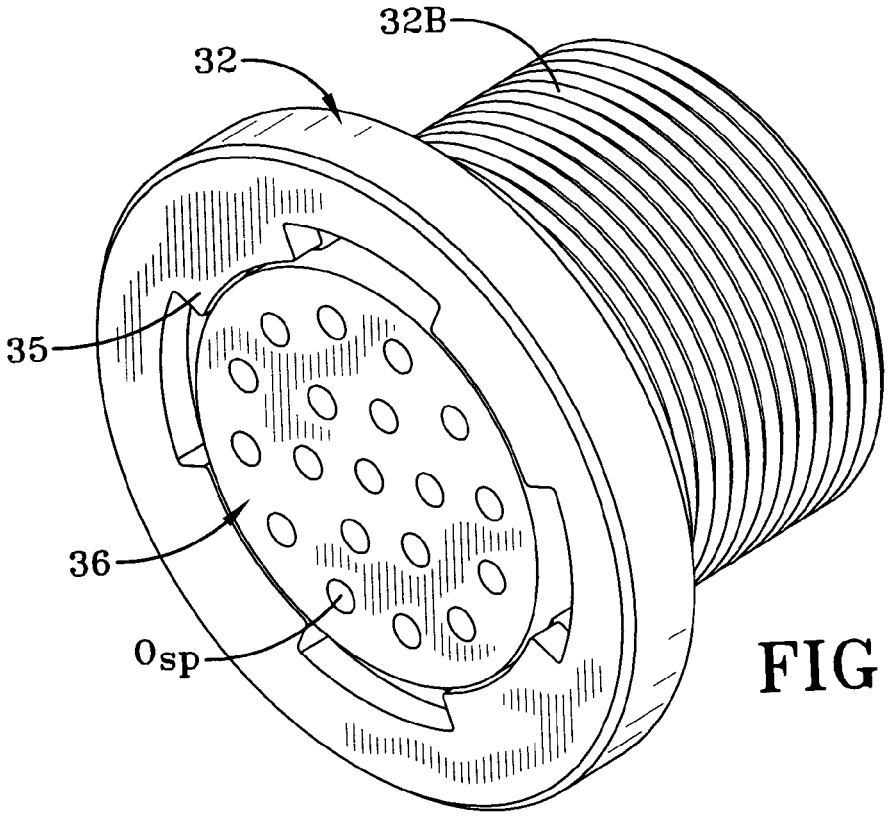
FIG. 7B is a perspective view of the screen debris plate and the flange portion of FIG. 6 showing the quarter turn attachment of the screen debris plate.

With reference to FIGS. 5 and 6 a first alterative embodiment of the present invention is shown. In this alternative flow restriction device 30 the couplings and the pipe can be replaced by two flanges 32, 34. One first flange 32 has a male threaded projected end 32B and the opposite second flange 34 has a female threaded projecting end 34A that can be attached to the male end 32B of the first flange 32 thereby securing the two flanges 32, 34 to the wall 151 and creating a conduit or passage through the submerged orifice 1. At the inlet end of the flange 32, the screen debris plate 36 can be retained in a recessed area as shown in FIGS. 7A and 7B. The orifice plate 38 preferably is removably retained in the same fashion in an external recessed area so that it can be replaced easily to increase or decrease the flow opening area Oa as previously discussed. Alternatively, the orifice plate 38 can be integral to the flange 34 and thus the entire flange 34 can be replaced or modified to change the orifice opening area Oa.

At the opposite inlet end of the device 30 the flange 32 may include an optional screen debris plate 36 which can be removably retained as shown in FIGS. 7A and 7B or can be made integral to the inlet flange 32.

In principle, this alternative device works in the same fashion as the preferred device, however, it can be made with as few as two flange pieces, one with an integral orifice plate, the other flange having an integral screen debris plate if so desired.

In the event that the wall thickness of the primary structure 150 is greater than the flanges 32, 34 can accommodate, a pipe insert (not illustrated) can be employed having one end with a male thread and an opposite end with a female thread to span the wall and permit physical attachment of the flanges 32, 34.

As shown the orifice plate 18, 38 or optional screen debris plate 16, 36 can be a separate part or integral to the couplings 14, 15 of FIG. 2A, 2B or the flanges 32, 34. The orifice plate 18, 38 or screen debris plate 16, 36 can be removably captively retained by the couplings 14, 15; the pipe 12, the flanges 32, 34 or any combination thereof. The orifice plate 18, 38 can be glued to the couplings 14 or threaded into said coupling 14 or flange 34 or simply retained using slots or other mechanical restraining features as shown in FIGS. 6, 7A and 7B; quarter turn tabs 35, 37 may secure the plates 16, 18, 36, 38 to the devices 10, 30. In any event the precise method of attachment should simply insure the device 10, 30 is securely fixed to the wall 151 of the structure 150 through the orifice opening 1. The use of the catch basin concrete wall 151 insures sufficient strength to prevent the device from dislodging.

Figure 8:
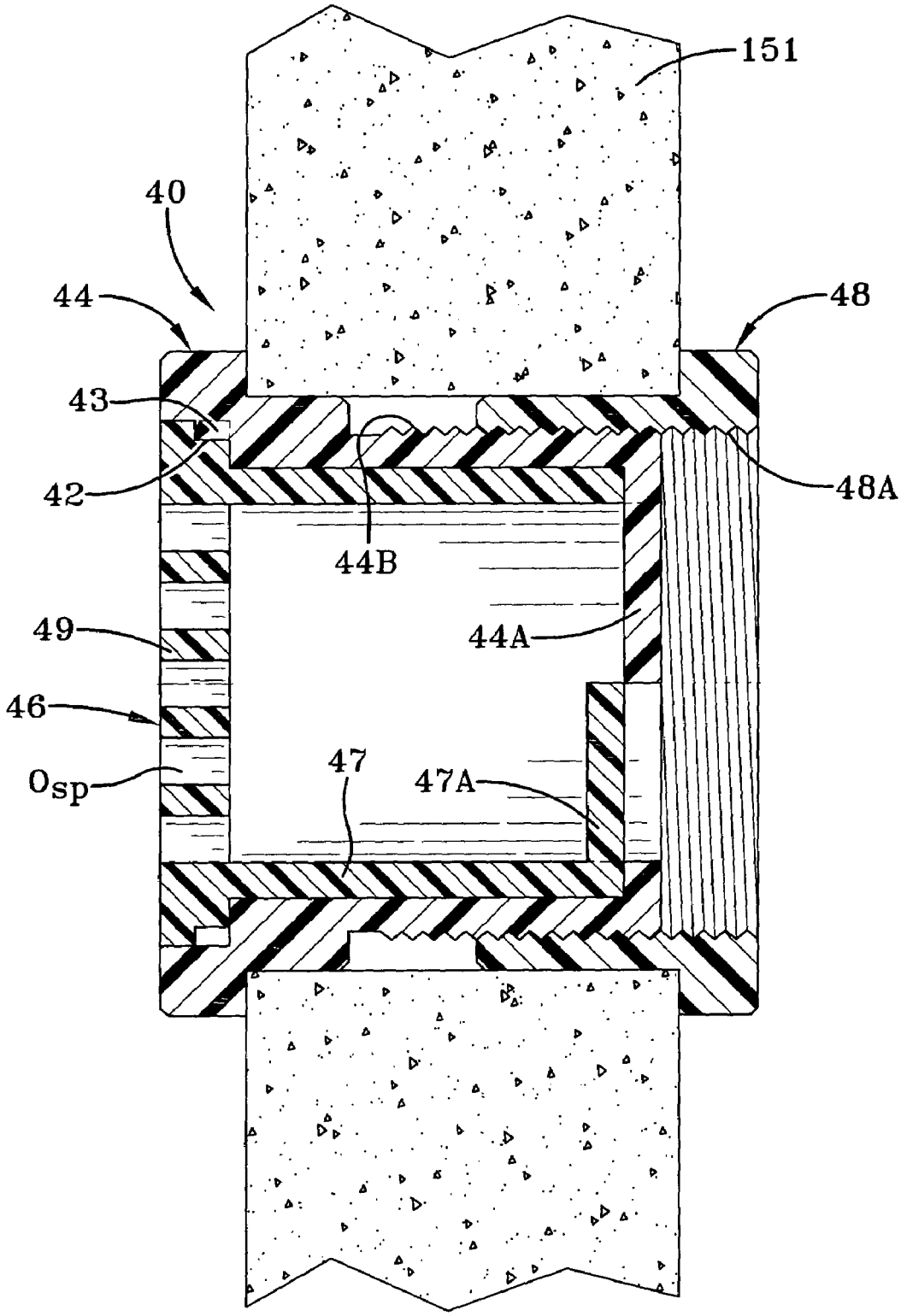
FIG. 8 is a cross sectional view of the second alternative embodiment flow restrictor assembly attached through the submerged orifice.
Figure 9A:
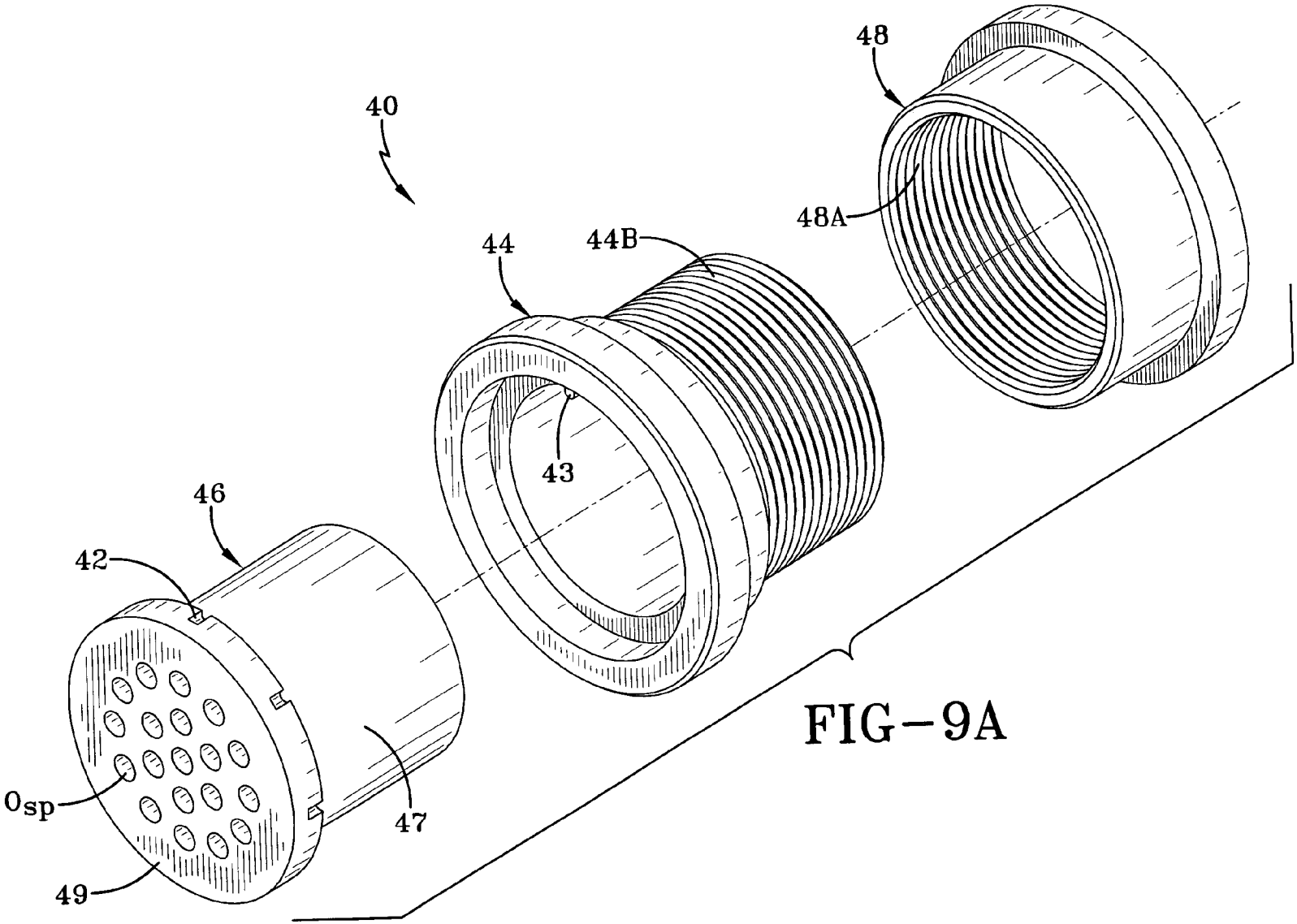
FIG. 9A is a first exploded view of the flow restrictor device of FIG. 8 looking toward the screen debris end of the assembly.
Figure 9B:
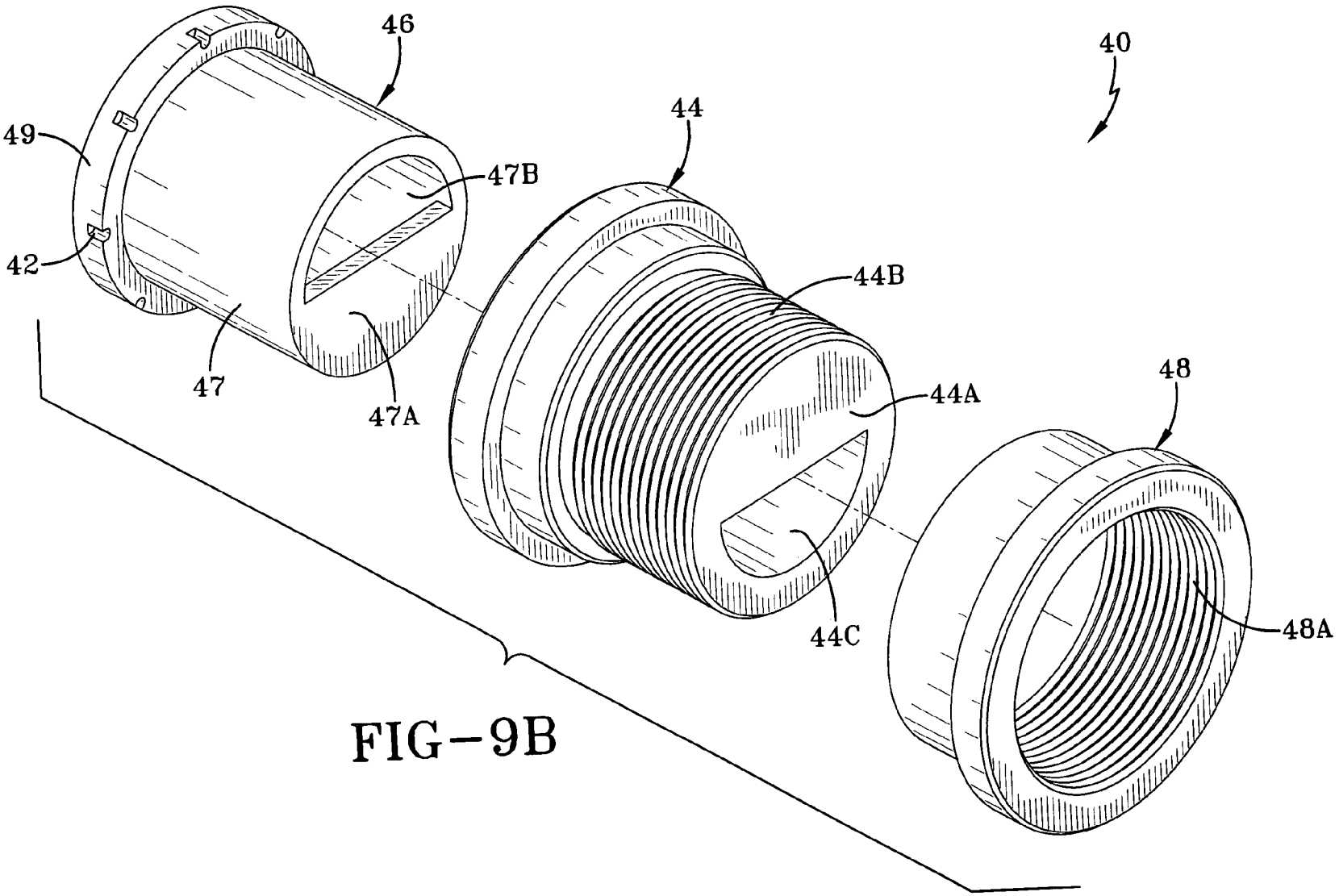
FIG. 9B is a second exploded view of the flow restrictor device of FIG. 8 looking toward the variable orifice plate portions of the assembly, one orifice plate portion being on the screen debris sleeve, the other orifice plate portion being on the flange coupling.
Figure 11:
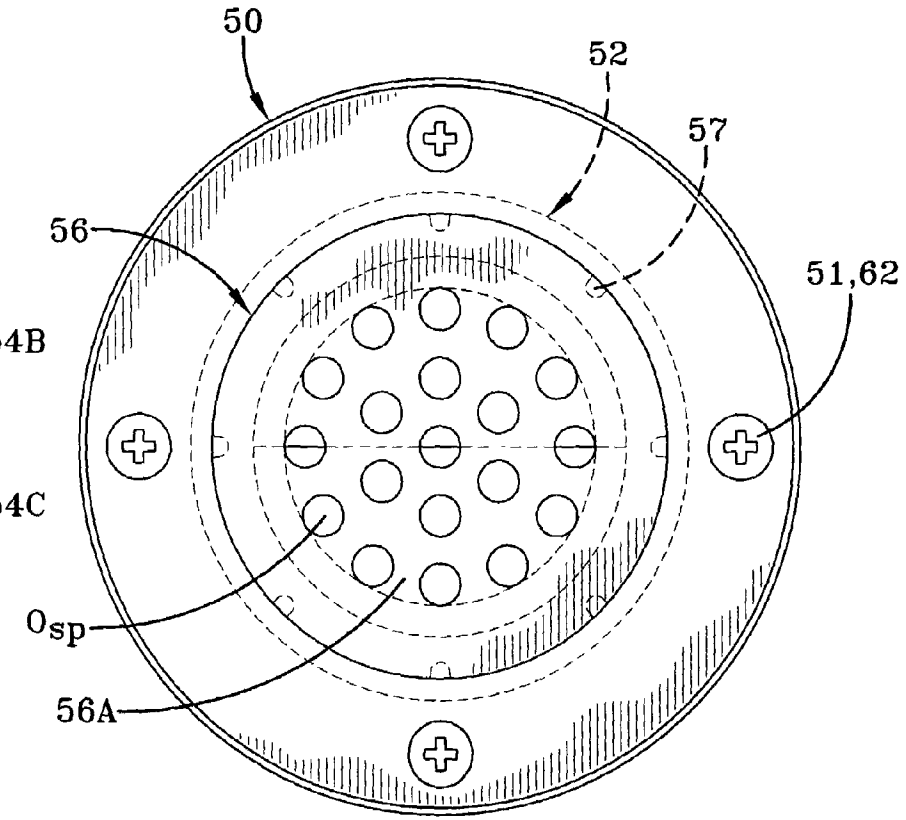
FIG. 11 is an end plan view of the third embodiment shown in FIG. 10.

With reference to FIGS. 8, 9A, 9B a second alternative flow restrictor device 40 is illustrated. The device 40 employs a screen debris portion 46 having a cylindrical sleeve portion 47 and an end plate portion 49 with openings Osp. The end plate portion 49 has a plurality of slots 41 adapted to engage an orientation protrusion or key 43. The screen debris portion can be slipped into the flanged coupling 44 and one of the slots 42 can be aligned over the projection or key 43. The flanged coupling 44 has a male threaded portion 44B that can be threadingly attached to the securing flange coupling 48 having female threads 48A.

With reference to FIG. 9B as can be shown the screen debris portion 46 has a sleeve end plate portion 47A of the cylindrical sleeve portion 47. The sleeve end plate portion 47A covered a portion of the end of the cylindrical sleeve leaving an orifice opening 47B. The screen debris portion 46 fits into the interior of the flange coupling and when it is slid into the flange coupling 44 the opening 47B can be blocked at least partially by the flange coupling end plate portion 44A. The flange coupling end plate portion 44A partially covers the cylindrical walls at an end of the thread portion 44B of the flange coupling 44 leaving an orifice opening 44C. As shown, the flange coupling end plate portion 44A covers about 50% of the end and has semicircular area leaving a semicircular opening 44C. The sleeve end plate portion 47A of the sleeve 47 has a similar semicircular area leaving a semicircular orifice or open area 47B, the orifice area 47B being less than 44C due to the wall thickness of the sleeve 47.

Upon assembly, the semicircular opening 47B can be blocked fully by the flange coupling end plate portion 44A or can be opened from partially to fully opened dependent on the alignment with the opening 44C with the opening 47B. When assembled the parts 44, 46, 48 make a three piece assembly wherein the orifice opening Oa can be selected and is dependent on the alignment of the opening 44C and 47B relative to the end plates 47*a* and 44A. The alignment can be maintained by the key 43 engaging one of the slots 42 as shown.

In this embodiment, the device 40 is simply adjusted by changing the orientation of the sleeved screen debris portion 46. As in the other embodiments, the threaded portions 44B, 48A can be replaced by gluing. Similarly, when the optimal orifice opening Oa is found the sleeve can be glued into place if so desired.

With reference to FIGS. 10, 11, 12 and 13 a third alternative embodiment flow restrictor device 50 of the present invention is shown as well as a variation of that device 50 with a pin. The device 50 as shown can be made as a two piece assembly. The first flanged portion 52 can be slipped into the orifice 1 of the wall 151 and secured to the wall using concrete fasteners 62, as shown countersunk screws 62 which pass through flange holes 51. This first flange has an end plate 54B having a semicircular area leaving an orifice opening 54C similar to the embodiment 40 found in FIGS. 8, 9A and 9B.

Figure 10:
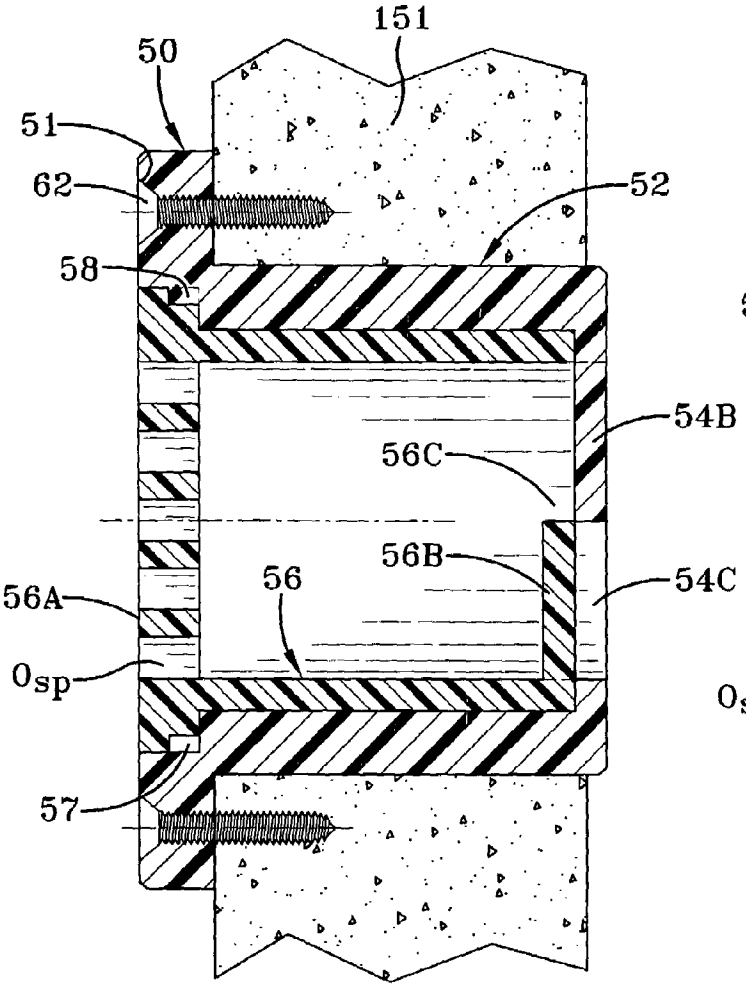
FIG. 10 is a cross sectional view of a third alternative embodiment according to the present invention, the third embodiment of the invention employing the variable orifice plate portions of the assembly shown in FIG. 8, but in a two piece flange secured assembly.

In this embodiment, the device 50 has a sleeved portion 56 having an optional screen debris end plate 56A glued, welded or otherwise integral to the sleeved portion 56 and at an opposite end an end plate 56B of a semicircular area leaving an orifice opening 56C. As shown in FIG. 10, the orifice openings 54C and 56C are blocked by the end plates 56B, 54B respectively. As in the previous device 40, slots 57 can be placed in a plurality of locations around the circumference of the sleeve 56 such that when mated to a projection or key 58 on the first flanged portion 52 the orifice opening Oa can be selected. As in the other embodiments the opening Oa can be varied from blocked to fully open and virtually any size Oa therebetween based on the number of slots 57 used.

Once the optimum opening is determined the two parts can be permanently glued together if so desired.

Figure 13:
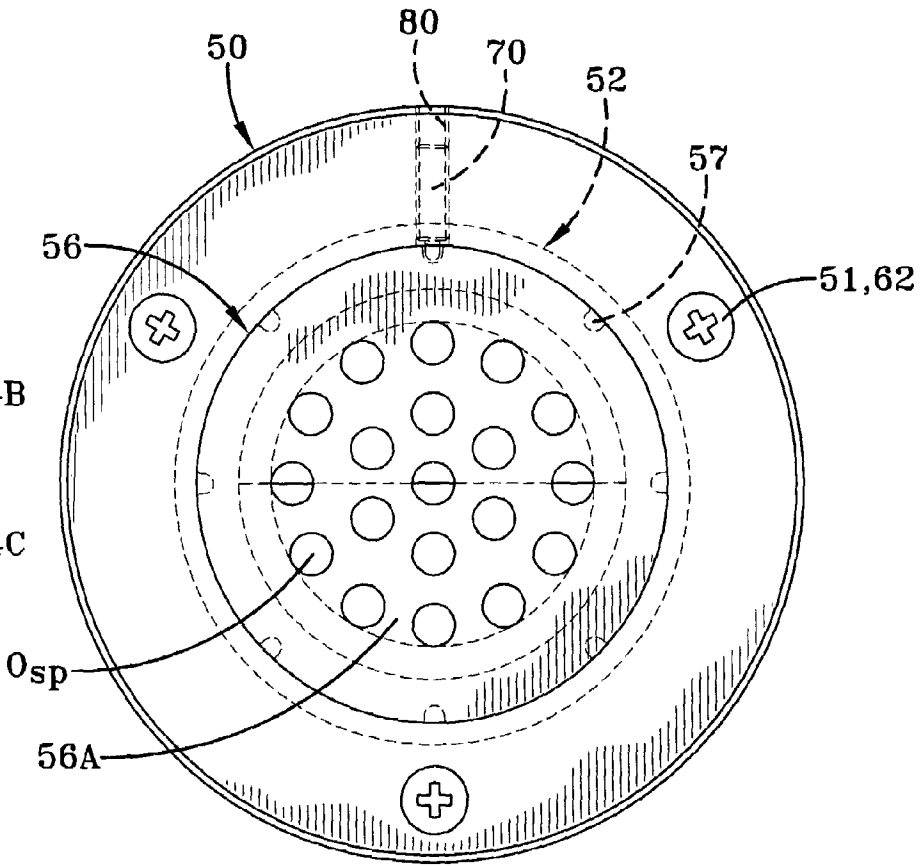
FIG. 13 is an end plan view of the flow restrictor device of FIG. 12.
Figure 12:
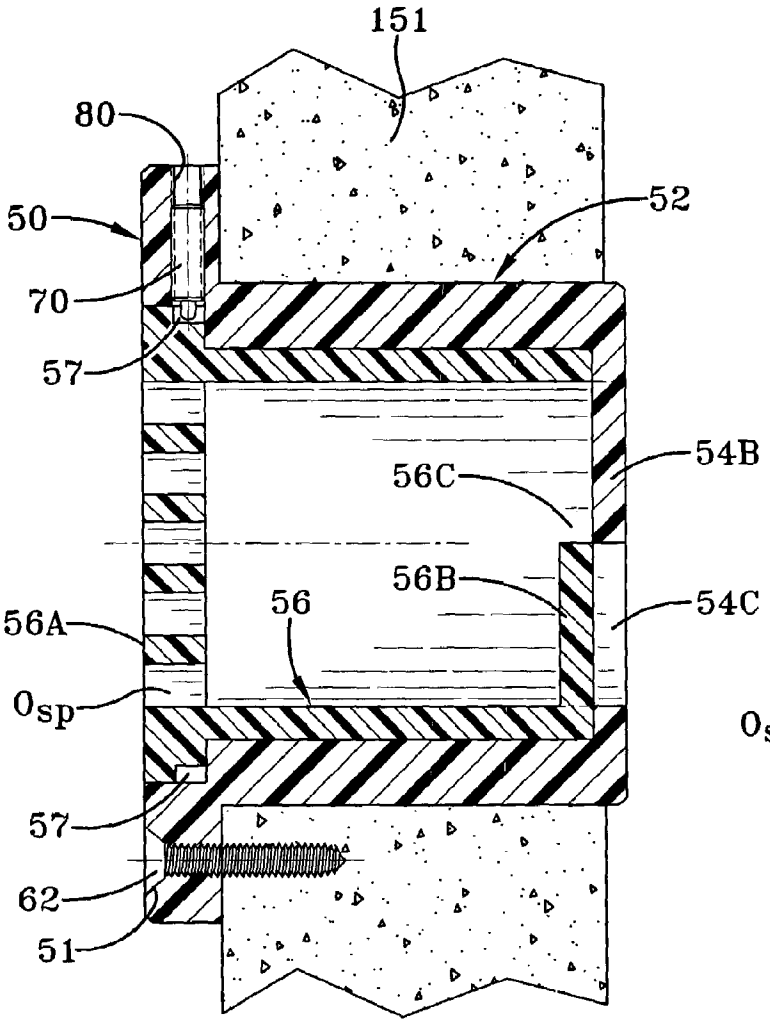
FIG. 12 is a cross sectional view of a flow restrictor device of FIG. 10 with a pin for fixing the variable orifice size.

With reference to FIGS. 12 and 13, the devices 50 can be further modified by using a pin 70 threaded into a flange opening 80. The pin can be adapted to lock into a slot opening 57 the device simply snaps into a slot when the inner sleeve portion 52 is rotated.

Figure 15:
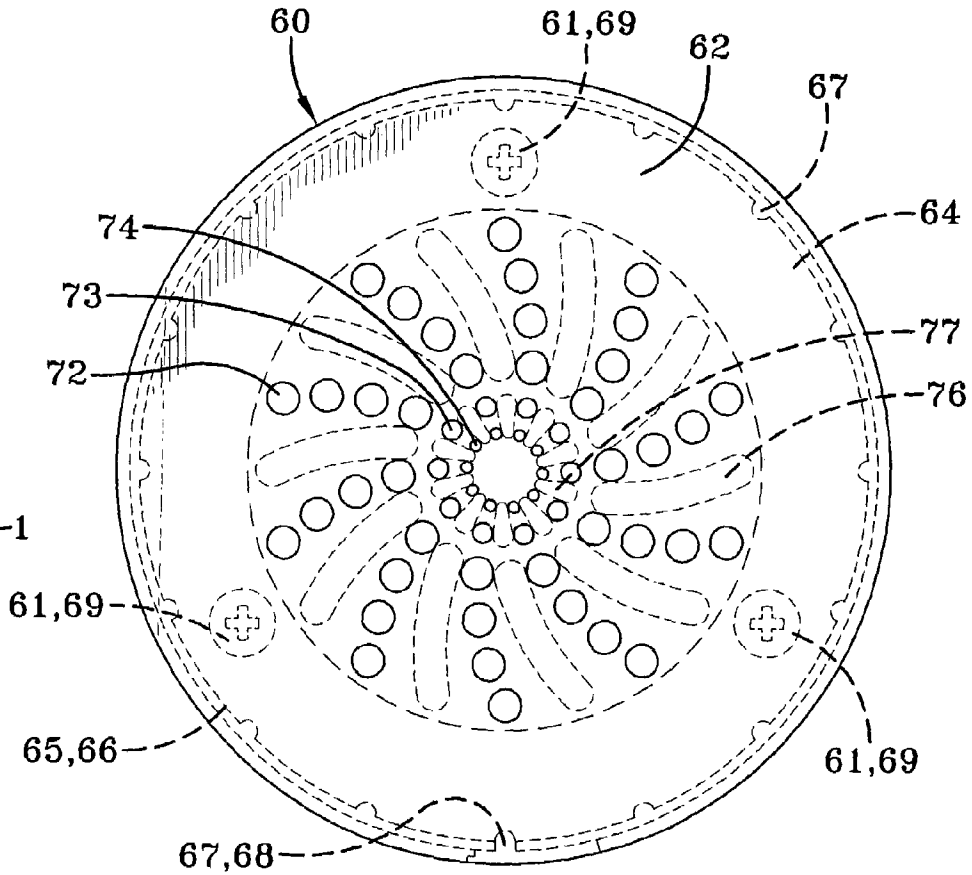
FIG. 15 is a plan view of the fourth alternative embodiment of the present invention taken from FIG. 14.
Figure 14:
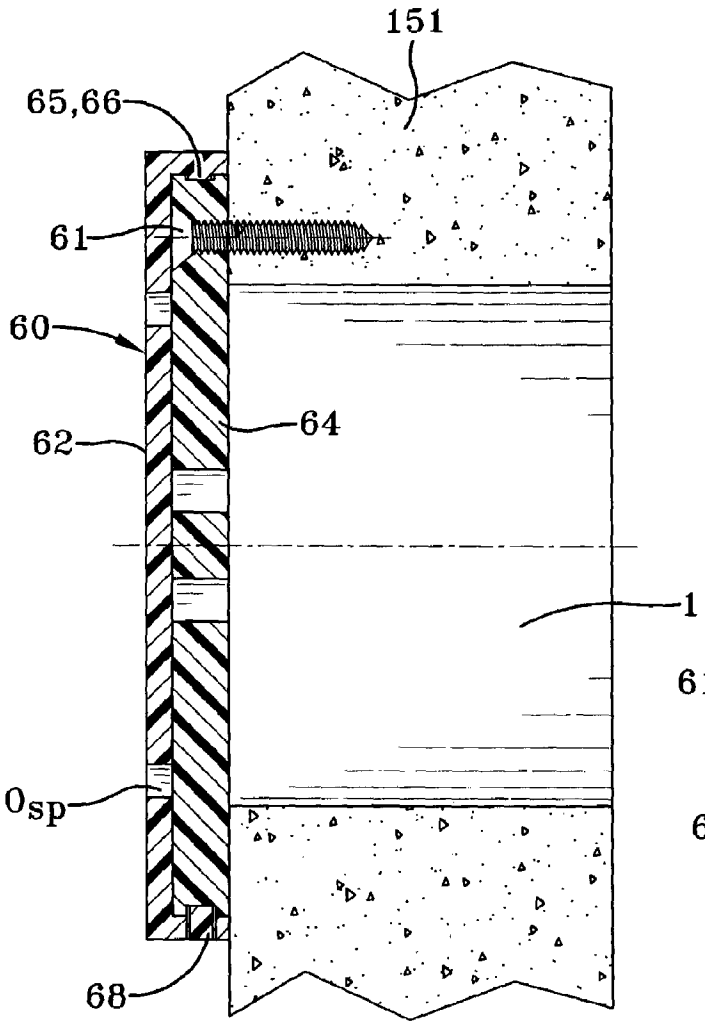
FIG. 14 is a cross sectional view of a fourth alternative embodiment flow restriction device according to the present invention.

With reference to FIGS. 14 and 15 a flow restrictor device assembly 60 according to a fourth alternative embodiment of the invention is shown. In this embodiment two overlapping flange plates, an exterior screen debris plate 62 and an interior orifice plate 64 are shown as an assembly 60.

The interior plate 64 is fastened to the wall 151 using concrete screws 61 through an opening 69. Then the exterior screen debris plate 62 is snapped onto the interior orifice plate 64 as shown and the annular rib 65 fits in the groove 66 as shown. A key pin 68 is pressed into the slot 67.

A plurality of openings or holes 72, 73, 74 of a variety of sizes are shown on the exterior screen debris plate and a plurality of orifice openings or slots 76, 77 are located on the interior orifice plate 64.

By rotating the exterior plate 62 relative to the interior pate a change in the orifice opening Oa can be made. The opening holes 72, 73, 74 can be blocked completely or aligned with the openings or slots 76, 77 to be partially opened to fully opened resulting in a maximum flow. Accordingly, the opening area Oa is the area defined by the amount of opening area in alignment of the plurality of openings on the screen debris plate and the plurality of openings on the orifice plate.

One advantage to the assembly 60 is that it can be designed without requiring a size a specified to the submerged orifice dimension as such it can be designed to fit sizes from say 4.0 inches to 12 inches by way of example. The parts 62 and 64 can be designed pre-assembled with an opening on the exterior screen debris plate 62 that can be aligned with the opening 69 such that the entire screw head can pass through. As each screw is attached to the wall 151 the opening can be rotated to the next opening 69. In this fashion the installation requires no other assembly other than selecting the estimated orifice size or area Oa.

In each embodiment certain locking keys and slots or fastening techniques are shown. Those skilled in the art will recognize various substitutions or variations can be used to accomplish the task. Accordingly such features are meant to be exemplary, but not intended to be limiting.

In each of the third, fourth and fifth alternative embodiments as illustrated in FIGS. 8-15, the orifice opening Oa is changed or selected by a rotation of a first part with one or more openings relative to a second part with one or more openings. In each case it is believed important that the openings are closely positioned if not abutted so that the aligned resultant orifice area Oa can be truly restricting the storm water flow and to minimize hydraulic effects trying to separate the parts. Accordingly the parts should be firmly secured together.

Furthermore, while the various orifices are shown as semicircular, circular or slots the exact shape of these apertures can be a matter of design choice and thus alterations in size and shape are contemplated to be within the scope of the present invention.

As shown the typical storm water runoff catch basin orifice has a diameter of about 6 inches. Small systems may exist having orifice diameters of less than 6 inches, or about 4 inches or less. While large systems may have orifice diameters between 6 and 12 inches. Regardless of the orifice diameter a flow regulator device 10, 30, 40, 50 as described herein can be fitted to mate to the orifice and provide the flow restrictor device with an orifice area Oa as described above.

The method of practicing the present invention allows the use of the water quality volume retained in the overall catch basin system or flood control detention pond to be part of the flood control volume. This is enabled by the use of any one of the flow restriction devices 10, 30, 40, 50 and 60 of the present invention which slows down the rate of drainage, but permits the captured storm water to drain over the prescribed period of draw down time to provide water quality volumes.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the full intended scope of the invention as defined by the following appended claims.

What is claimed is:

1. A storm water gravity flow restriction device for use in any drainage orifice comprising:

an inlet end for receiving storm water;

a discharge end for releasing storm water, the discharge end being open to the inlet end;

an orifice plate attached or integral to the discharge end, the orifice plate having a frontal surface area A and at least one opening for the passage of fluid of an area Oa, wherein Oa is less than A;

a first flange having a projecting end and a central screen debris plate with a plurality of spaced openings at an inlet end the projecting end extending toward the discharge end;

a second flange having a recessed portion at the discharge end and a projecting end extending toward the inlet end; the orifice plate being retained in said recessed portion; and wherein said first and second flange ends can be joined at said respective projecting ends.

2. The storm water gravity flow restriction device of claim 1 further comprising:

a screen debris plate attached or integral to the inlet end, the screen debris plate having a plurality of spaced openings for the passage of fluid, the sum area of the openings being Σ Osp wherein Σ Osp is greater than Ga.

3. A storm water gravity flow restriction device comprising:

an inlet end for receiving storm water;

a discharge end for releasing storm water, the discharge end being open to the inlet end;

an orifice plate attached or integral to the discharge end, the orifice plate having a frontal surface area A and at least one opening for the passage of fluid of an area Oa, wherein Oa is less than A;

a screen debris portion at the inlet end having a cylindrical sleeve portion extending toward the discharge end and a sleeve end plate portion covering a portion of an end of the cylindrical sleeve, leaving an opening in the discharge end;

a flange coupling at the inlet end having a cylindrical portion for holding the screen debris portion extending to a flange coupling end including the orifice plate covering an end of the flange coupling leaving an orifice opening at the discharge end; and wherein said sleeve portion is slid into said flange coupling such that the orifice opening Oa can be selected dependent of the alignment of the opening on the screen debris sleeve end plate portion and the flange coupling end orifice plate.

4. The storm water gravity flow restriction device of claim 3 further comprising:

a securing flange coupling attached to the flange coupling at the discharge end.

5. The storm water gravity flow restriction device comprising:

an inlet end for receiving storm water;

a discharge end for releasing storm water, the discharge end being open to the inlet end;

an orifice plate attached or integral to the discharge end, the orifice plate having a frontal surface area A and at least one opening for the passage of fluid of an area Oa, wherein Oa is less than A;

an exterior screen debris plate at the inlet end, the exterior screen debris plate having a plurality of openings, and overlapping the orifice plate, the orifice plate having a plurality of openings; and wherein the exterior screen debris plate overlaps the orifice plate, and the orifice opening area Oa is the area defined by the amount of opening area in alignment with the plurality of openings on the screen debris plate and the plurality of openings on the orifice plate.

6. The storm water gravity flow restriction device of claim 5 wherein the openings on the screen debris plate are holes and the openings on the orifice plate are slots.

* * * * *